US009169669B2

(12) United States Patent
Clary et al.

(10) Patent No.: US 9,169,669 B2
(45) Date of Patent: Oct. 27, 2015

(54) LOCK STATUS INDICATOR

(71) Applicant: Schlage Lock Company LLC, Indianapolis, IN (US)

(72) Inventors: Bradley Thomas Clary, Cincinnati, OH (US); Steven Verderaime, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 14/189,615

(22) Filed: Feb. 25, 2014

(65) Prior Publication Data

US 2015/0240526 A1 Aug. 27, 2015

(51) Int. Cl.
*E05B 41/00* (2006.01)

(52) U.S. Cl.
CPC ..... *E05B 41/00* (2013.01); *Y10T 70/8027* (2015.04)

(58) Field of Classification Search
CPC ..... E05B 41/00; E05B 19/22; E05B 17/10; E05B 17/22; E05B 17/226; E05B 2047/0069; Y10T 70/8027
USPC ..... 70/134, 419, 21, DIG. 59, 432–441, 70/DIG. 3; 116/8–10, 12, 80
See application file for complete search history.

(56) References Cited

U.S. PATENT DOCUMENTS

| | | | | | |
|---|---|---|---|---|---|
| 747,252 | A | * | 12/1903 | Smith | 40/460 |
| 871,126 | A | * | 11/1907 | Lockett | 40/460 |
| 943,637 | A | * | 12/1909 | Schoell | 70/432 |
| 999,044 | A | * | 7/1911 | Kuster | 70/145 |
| 1,216,899 | A | * | 2/1917 | Weyer | 40/460 |
| 1,337,401 | A | * | 4/1920 | Heberling | 40/460 |
| 1,362,647 | A | * | 12/1920 | Stone et al. | 40/460 |
| 1,529,766 | A | * | 3/1925 | Bina | 40/460 |
| 2,565,669 | A | * | 8/1951 | Smith | 116/290 |
| 2,784,993 | A | * | 3/1957 | Collar | 292/223 |
| 3,304,756 | A | | 2/1967 | Eads | |
| 3,695,068 | A | * | 10/1972 | Eads et al. | 70/107 |
| 3,699,788 | A | * | 10/1972 | Gerlach et al. | 70/134 |
| 4,012,929 | A | * | 3/1977 | Solovieff | 70/134 |
| 4,127,016 | A | * | 11/1978 | Ibsen | 70/92 |
| 4,490,999 | A | | 1/1985 | Castle et al. | |
| 4,559,796 | A | * | 12/1985 | De Forrest, Sr. | 70/432 |
| 4,607,510 | A | * | 8/1986 | Shanaan et al. | 70/95 |
| 5,275,029 | A | * | 1/1994 | Myers | 70/128 |
| 6,164,099 | A | * | 12/2000 | Sh | 70/134 |
| 6,354,122 | B1 | | 3/2002 | Snoke | |
| 6,938,445 | B2 | | 9/2005 | Huang | |
| 7,207,199 | B2 | * | 4/2007 | Smith et al. | 70/134 |
| 7,210,712 | B2 | * | 5/2007 | Artsiely | 292/97 |
| 7,213,426 | B2 | * | 5/2007 | Qing | 70/107 |
| 7,248,163 | B2 | | 7/2007 | Wu | |
| 8,037,725 | B2 | | 10/2011 | Levine | |
| 2006/0144103 | A1 | | 7/2006 | Blanch | |
| 2007/0214853 | A1 | * | 9/2007 | Huang | 70/432 |
| 2008/0289383 | A1 | * | 11/2008 | Levine | 70/432 |
| 2011/0016938 | A1 | * | 1/2011 | Chi | 70/432 |
| 2011/0167884 | A1 | | 7/2011 | Dumortier et al. | |

* cited by examiner

*Primary Examiner* — Lloyd Gall
(74) *Attorney, Agent, or Firm* — Taft Stettinius & Hollister LLP

(57) ABSTRACT

A lock assembly is disclosed that is operable to mechanically lock a moveable structure to a fixed structure. An escutcheon assembly having an indicator plate movable between a first position and a second position is operable to indicate a locked and unlocked configuration respectively of the lock assembly. A status indicator located proximate a front face and a pair of opposing side faces on the indicator plate to indicate a locked or unlocked status is visible across a 180 degree viewing angle.

26 Claims, 4 Drawing Sheets

LOCK STATUS INDICATOR

TECHNICAL FIELD

The present invention generally relates to a lock assembly, and more particularly, but not exclusively to displaying a status indicator of the lock assembly.

BACKGROUND

Lock assemblies are used to lock movable structural members such as doors, lids and the like to prevent movement from fixed structural members. Many types of lock assemblies do not display a visual indicator as to whether the lock assembly is in a locked or unlocked configuration. Some existing lock assemblies have a status indicator, but have various shortcomings relative to certain applications. Accordingly, there remains a need for further contributions in this area of technology.

SUMMARY

One embodiment of the present invention is a unique lock status indicator for a lock assembly. Other embodiments include apparatuses, systems, devices, hardware, methods, and combinations for an electronic lock. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 2:
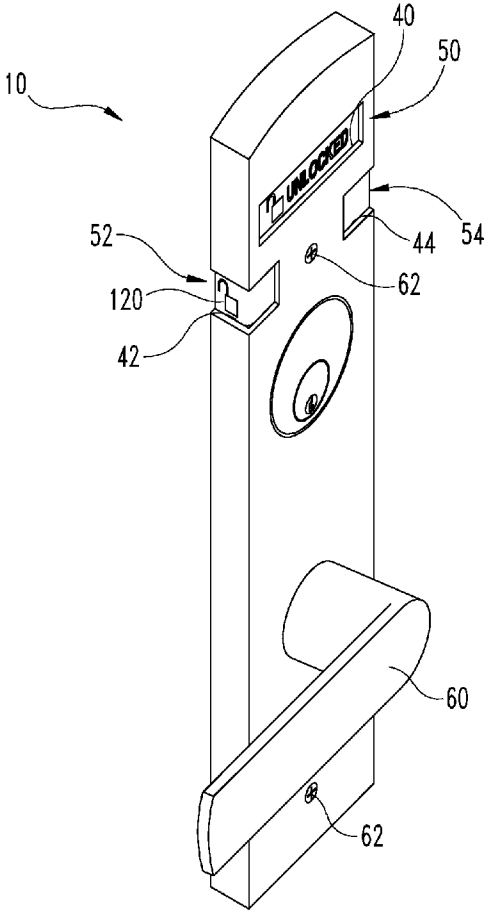
FIG. 2 is a perspective view of the escutcheon assembly of FIG. 1 having an unlocked status indicator.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 1:
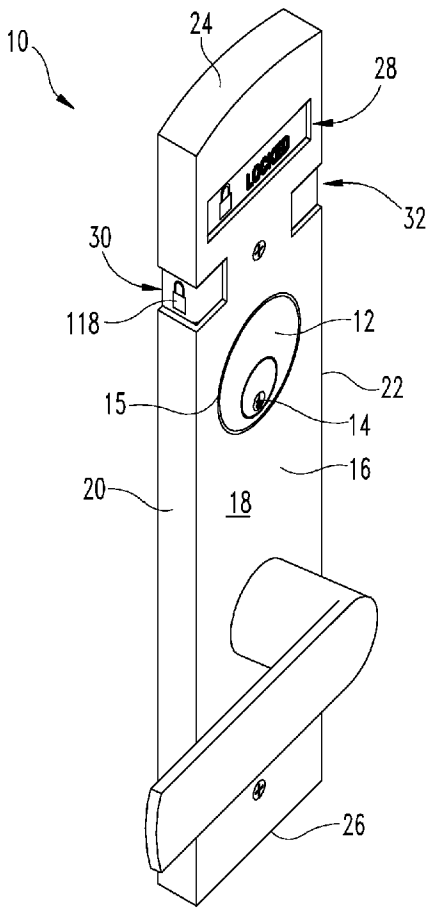
FIG. 1 is a perspective view of an escutcheon assembly having a locked status indicator.

Referring to FIGS. 1 and 2, an escutcheon assembly 10 is illustrated therein. The escutcheon assembly 10 includes a lock cylinder 12 having a keyway 14 positioned within an aperture 15 formed in an escutcheon plate 16. The escutcheon plate 16 includes a front face 18 that extends between first and second sidewalls 20, 22 and between a top wall 24 and a bottom wall 26. The escutcheon plate 16 further includes a front face opening or window 28 and first and second sidewall openings or windows 30, 32, respectively. The front face window 28 includes a perimeter profile 40 that in this exemplary embodiment is depicted as a rectangle, however it should be understood that any style or shape is contemplated by the present application. For example, the perimeter profile can have curved sides, edges and/or corners that form complex shapes. The first and second sidewall windows 30, 32 include a perimeter profile 42, 44 respectively that in one form includes a cutout wraparound from each of the sidewalls into the front face 18 of the escutcheon plate 16. It is contemplated that in other embodiments the first and second sidewall windows 30, 32 may not extend across portions of the front face 18 of the escutcheon plate 16. Furthermore in yet another form, the escutcheon plate 16 may have substantially one continuous window extending from the sidewalls 20, 22 and across the front face 18. A status indicator 50 indicating whether the lock assembly is locked or unlocked can be displayed through the front face window 28. Similarly, the status indicators 52 and 54 can be displayed through the first and second sidewall windows 30, 32 respectively of the escutcheon plate 16. The status indicator 54 on the second sidewall 22 is not visible in this drawing, but can be seen in FIGS. 3 and 4. In some forms, the status indicators 50, 52, 54 may all be positioned above the lock cylinder 12. In other forms, the status indicators 50, 52, 54 may all be positioned below the lock cylinder 12. In yet other forms, at least one of the status indicators 50, 52, 54 may be positioned on the opposite end (above or below) of the lock cylinder 12 relative to the others.

In this illustrative embodiment a pair of fasteners 62 is shown on the front face 18 of the escutcheon plate 16. These fasteners 62 can be used to fasten the escutcheon assembly 10 to a door or other movable structure (not shown) as is known to those skilled in the art. In other embodiments more or less fasteners may be used to fasten the escutcheon assembly 10. Also, a handle 60 is shown in this exemplary embodiment, however it should be understood that the escutcheon assembly 10 need not have a handle configured as shown in the drawings and in some embodiments may not have a handle at all.

Figure 3:
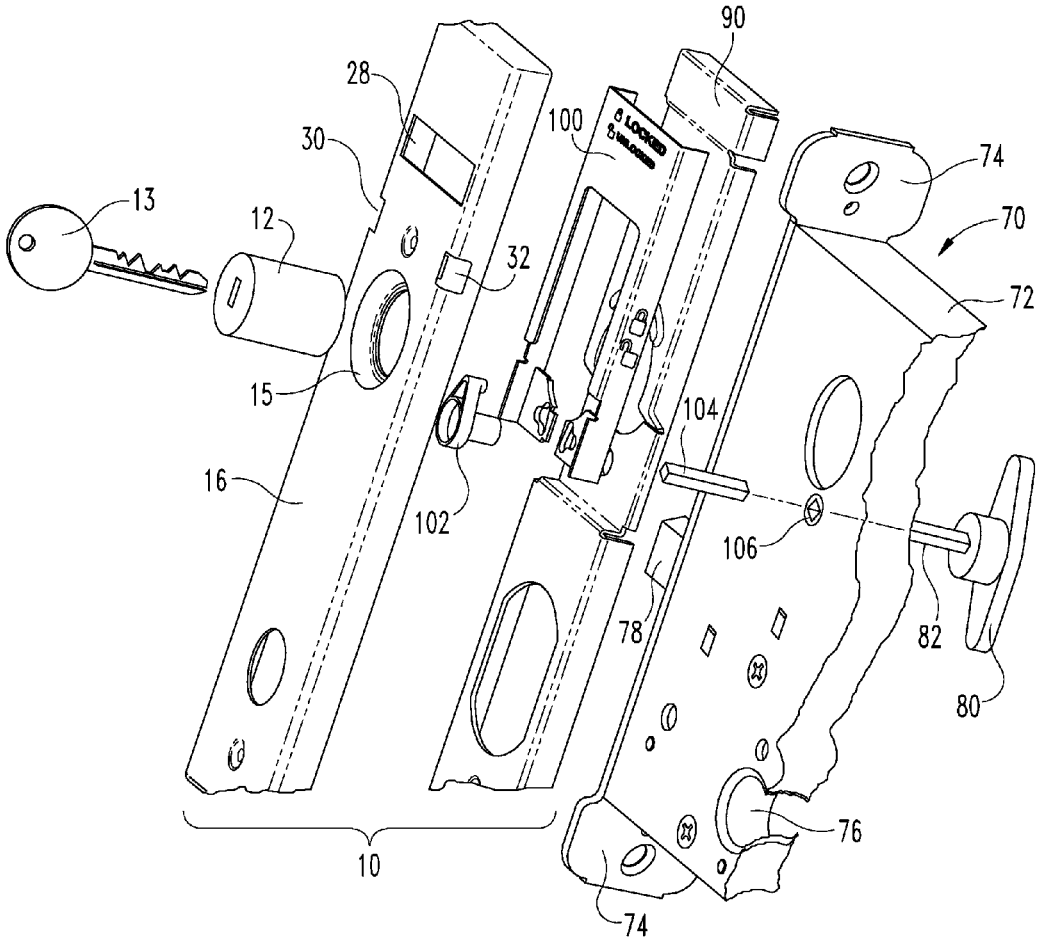
FIG. 3 is a perspective exploded view of the escutcheon assembly of FIG. 1 and a lock assembly partially cut away.

Referring now to FIG. 3, an exploded view of the escutcheon assembly 10 along with a lock assembly 70 is illustrated. The lock assembly 70 includes a case 72 partially cut away. The case 72 includes various lock components that are not shown but are understood to be present by those skilled in the art. By way of example and not limitation the lock assembly 70 can be mortise lock, however other types of lock mechanisms are contemplated by this application. The lock assembly 70 can include connecting flanges 74 formed on either end of the case 72 for fastening with a door or the like. A through aperture 76 for a shaft of the handle 60 is located towards the bottom of the lock assembly 70. The lock assembly 70 can also include a deadbolt 78 as is conventional with such lock assemblies. A thumb turn lever 80 can be coupled with the lock cylinder 12 by connecting shaft 82 that is operable for extending through the lock assembly 70 and into the lock cylinder 12. As is conventional, a key 13 or the thumb turn lever 80 can be used in conjunction with the lock cylinder 12 to lock or unlock the lock assembly 70.

The escutcheon assembly 10 can include a base or reinforcing plate 90 and a movable indicator plate 100 that is slidingly engagable with the base plate 90. The escutcheon plate 16 is constructed to generally cover the indicator plate 100 while allowing a portion with status indicators to be displayed through one or more openings therein. A cam 102 is operably connected to the lock assembly 70 through a drive bar 104. The cam 102 is operable for engaging with the indicator plate 100 and moving the indicator plate between first and second positions as the lock assembly 70 from locked or unlocked orientations. In some alternate forms intermediate mechanical components can be operably coupled between the cam 102 and the indicator plate 100. The drive bar 104 can be connected to the lock assembly 70 through a drive bar receptacle 106 that rotates the drive bar 104 between clockwise and counter-clockwise rotations corresponding to locking and unlocking the lock assemble 70. As shown in one form, the drive bar 104 can have a cross-sectional shape that corresponds to a cross-sectional shape of the drive bar receptacle 106 and a receptacle formed in the cam 102 such that torque can be transmitted therebetween. In other forms the connection between the drive bar 104, the drive receptacle 106 and cam 102 and can include different configurations that require mechanical fasteners such as set screws or the like.

Figure 4:
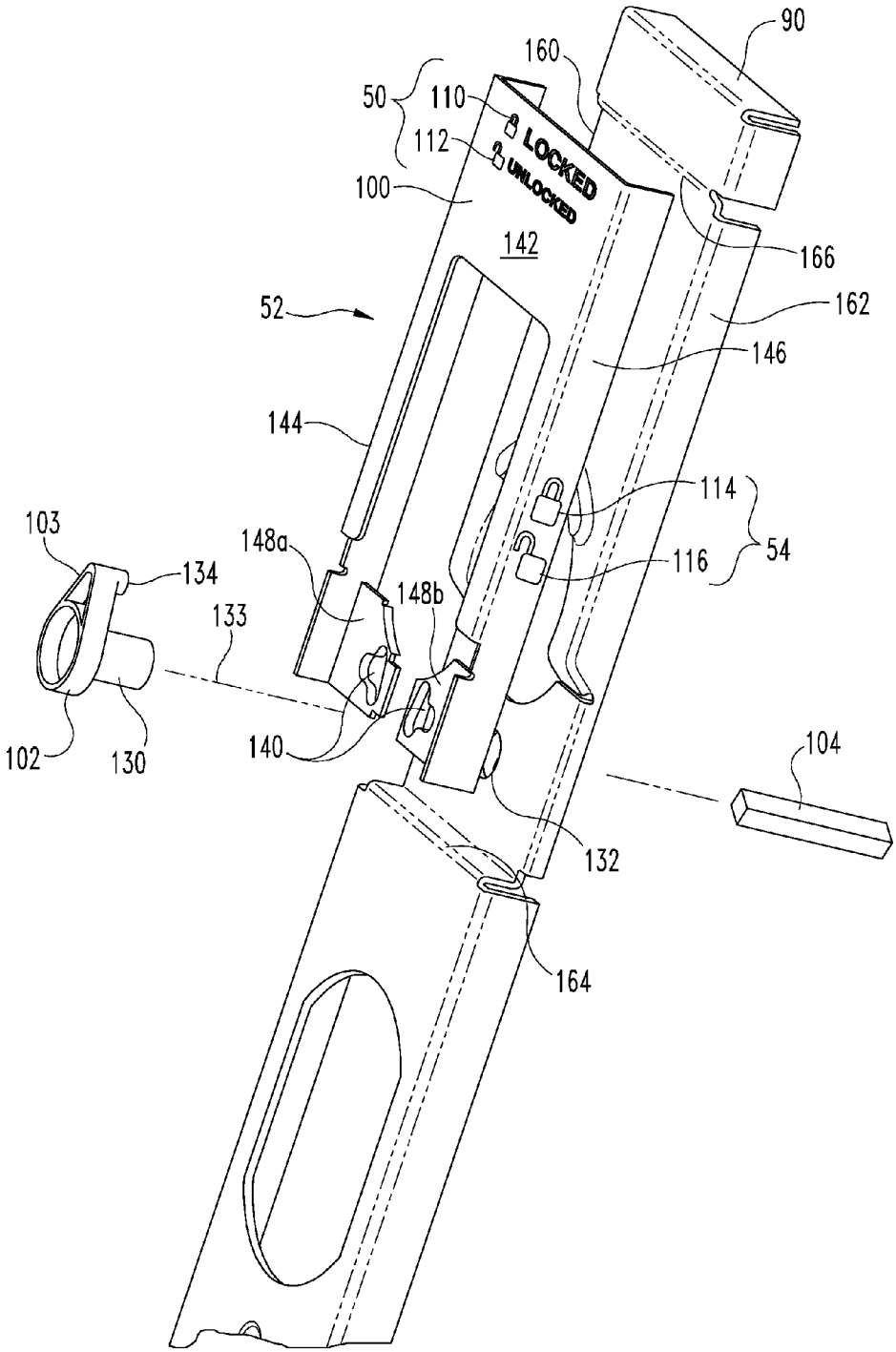
FIG. 4 is an enlarged view of a portion of the escutcheon assembly shown in FIG. 3.

Referring now to FIG. 4, a portion of the escutcheon assembly 10 is enlarged and will be described in more detail below. The indicator plate 100, as illustrated in the exemplary embodiment includes a status indicator 50 located on the front face 18 thereof. The status indicator 50 includes a locked indicator 110 and an unlocked indicator 112. In one form the locked indicator 110 can be positioned above the unlocked indicator 112, but in other forms the locked and unlocked indicators 110 and 112 can be swapped to opposing positions. As described previously, a pair of side status indicators 52 (not shown in FIG. 4) and 54 can include a closed padlock symbol to represent a locked indicator 114 and an open padlock symbol to represent an unlocked indicator 116. On the opposing side of the indicator plate 100 a locked indicator 118 and an unlock indicator 120 (see FIGS. 1 and 2) is positioned in similar fashion.

The cam 102 can include a pivot shaft 130 that can extend through an aperture 132 formed in the reinforcement or base plate 90 and pivot about an axis 133. The pivot shaft 130 can be connected with the drive bar 104 so as to receive an actuation torque from the drive bar receptacle 106. A cam lobe 103 can be positioned proximate one end of the pivot shaft 130 and formed with a desired size and shape. In one form the cam 102 can include working portion or pin 134 extending transverse from the cam lobe 103. The pin 134 can directly engage with a cam follower profile 140 that is connected to the indicator plate 100. In other forms the cam lobe 103 can directly engage the cam follower profile 140 to drive the indicator plate 100.

The indicator plate 100 includes a front face 142 and first and second sidewalls 144, 146 extending therefrom. The first and second sidewalls 144, 146 can act at least partially as a guide for the indicator plate 100 to slidingly engage along a portion of the base plate 90. A pair of extensions 148*a*, 148*b* can be integrally formed or connected via mechanical fastening means from the first and second sidewalls 144, 146 to house the cam follower profile 140. A separate cam follower profile 140 can be formed in conjunction with each sidewall 144, 146 of the indicator plate 100 so that the escutcheon assembly 10 can be used with doors that have either left-handed or right-handed openings. The cam 102 will move the indicator plate 100 in one direction in response to a counter-clockwise rotation and move the indicator plate 100 in the other direction in response to a clockwise direction. The indicator plate 100 will move in opposite directions in response to rotation of the cam 102 when the cam 102 is engaged with the opposing cam follower profile 140. For example, if the cam 102 is engaged with the cam follower profile 140 associated with extension 148*b* of sidewall 146, the indicator plate 100 will move upward in response to a counter-clockwise movement of the cam 102 and downward in response to a clockwise movement of the cam 102. When the cam 102 is engaged with the opposing follower 140 associated with the other sidewall 144, the indicator plate will move upward in response to a clockwise cam rotation and downward in response to a counter-clockwise cam rotation.

The base plate 90 is configured to provide support structure for the escutcheon plate assembly 10 and in one form can be attached directly to a door or other such structure. The base plate 90 can include a first sidewall 160 and a second sidewall 162 to act as a guide, also referred to as a guide portion, and otherwise support the moveable indicator plate 100. The first and second sidewalls 160, 162 can correspond with the sidewalls 144 and 146 of the indicator plate 100. While not shown in detail, it should be understood by one skilled in the mechanical arts that various features to enable sliding connection between the movable indicator plate 100 and the fixed base plate 90 can be employed to the advantage of this concept and remain within the scope of this disclosure. Such features can include, but are not limited to tongue and groove connections, clips, or other mechanical members.

A lower abutment 164 and an upper abutment 166 can be formed on the base plate 90 to function as a lower and an upper bounds for the indicator plate 100 to slidingly move therebetween. It should be understood that the total travel distance of the indicator plate 100 is a function of the distance of the pivot axis from the working portion 134 in combination with the cam follower profile 140. As such the indicator plate may or may not actually come into contact with the upper and lower abutments 166, 164 during operation.

Figure 5:
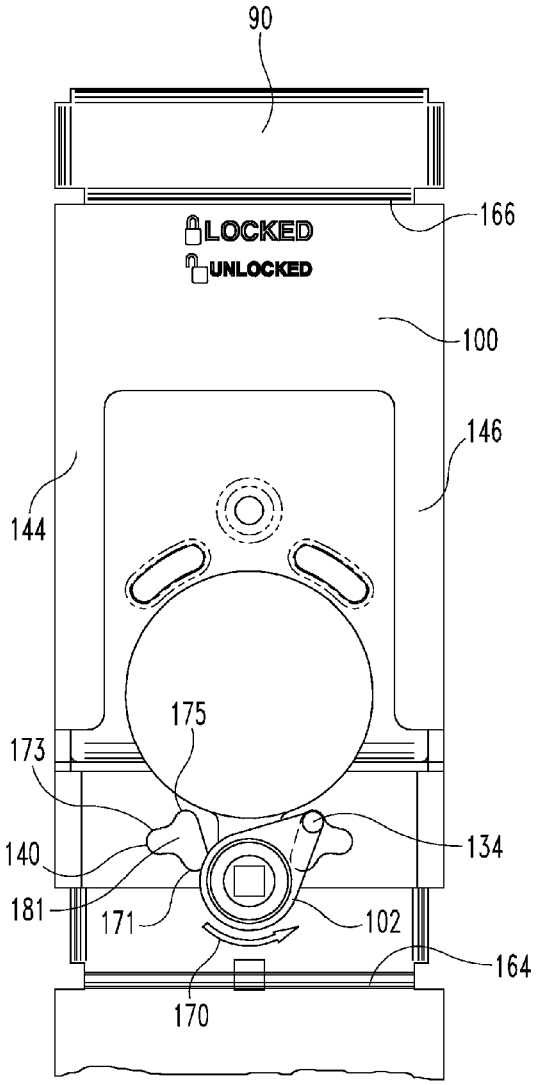
FIG. 5 is a plan view of a portion of the escutcheon assembly with an indicator plate located in a first position.
Figure 6:
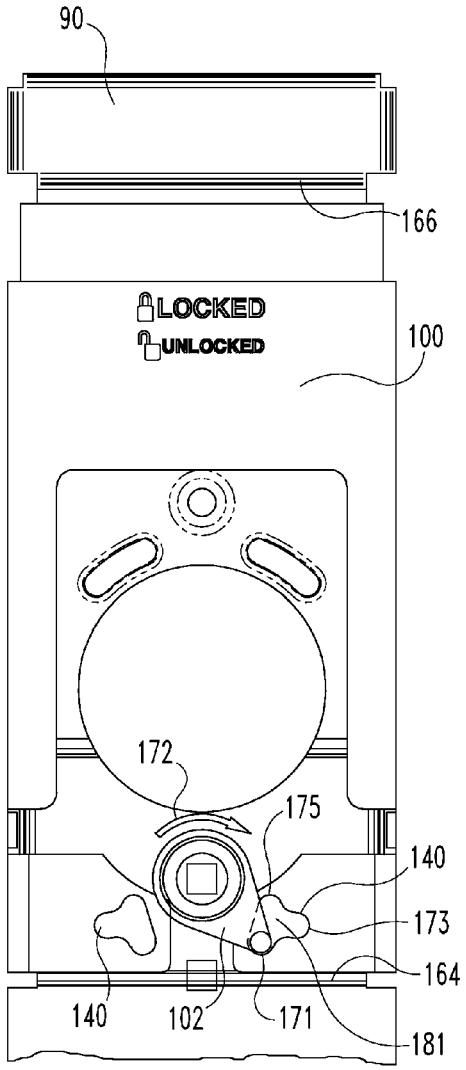
FIG. 6 is a plan view of the escutcheon assembly of FIG. 5 with the indicator plate located in a second position.

Turning now to FIGS. 5 and 6, the indicator plate 100 is shown in first and second positions corresponding in this exemplary form to the most upward position adjacent the upper abutment 166 and to the most downward position adjacent the lower abutment 164 of the base plate 90, respectively. The cam 102 is shown as being engaged with the cam follower profile 140 associated with the second sidewall 146. When the cam 102 is turned in a counter-clockwise direction as viewed forward looking aft and illustrated by arrow 170, the cam 102 causes the indicator plate 100 to move to the upper position proximate the upper abutment 166 as shown in FIG. 5. When the cam 102 is rotated in a clockwise direction illustrated by arrow 172 in FIG. 6, the cam 102 causes the indicator plate 100 to move toward the lower position proximate the lower abutment 164 of the base plate 90. The cam follower profile 140 as illustrated in the exemplary embodiment can include a generally arcuate "clover shaped" path having three lobes 171, 173, and 175 defined as a first lobe, intermediate lobe and third lobe respectively, each protruding radially outward from a center point 181 of the cam follower profile 140.

In one form the three lobed cam follower profile 140 operates to deadlock the indicator plate 100 such that the indicator plate 100 cannot be moved without first pivoting or rotating the cam 102 to cause the pin 134 to move out of engagement with the first or third lobes 171, 175 and into engagement with the intermediate lobe 173. The deadlocking feature works to prevent someone from using external force on the indicator plate 100 to move the indicator plate 100 between the locked and unlocked positions without using a key or proper electronic authentication for electronic locks. As the indicator plate 100 is mechanically coupled through the cam 102 to the lock mechanism (not described in detail), the lock mechanism could be unlocked (or locked) if the indicator plate 100 were independently moveable with an external force. With the three lobed cam follower profile 140, an external sliding force exerted on the indicator plate 100 will merely cause the pin 134 of the cam 102 to move toward or engage with more contact force the outermost perimeter of the first or third lobes 171, 175 depending on the lock status position. Because the first and third lobes 171, 175 are generally aligned in the direction of travel of the indicator plate 100, the indicator plate 100 cannot move in a linear direction without the pin 134 initially being rotated or pivoted into the intermediate lobe 173 of the cam follower profile. In this manner, the deadlock three lobe cam follower profile 140 prevents tampering and/or bypassing the lock by eliminating the ability of someone to simply force the indicator plate 100 to slide between first and second positions corresponding to a locked and an unlocked configuration respectively.

It should be understood that the three lobed clover shaped pattern is only one non-limiting embodiment and other cam follower profile configurations can be used and are contemplated by the present disclosure. Also, once again it should be noted that if the cam 102 is engaged with the opposing cam follower profile 140 associated with sidewall 144, the direction of movement for the indicator plate 100 would be in the opposite direction to that shown in the illustrated configurations of FIGS. 5 and 6. Furthermore it is reiterated that rotation directions and positions labeled as left or right, up or down, clockwise or counter-clockwise, etc., are relative to a particular reference orientation and are not to be construed as absolute or controlling for purposes of this disclosure.

In operation the status indicator displayed by the escutcheon assembly is controlled by a key or thumb turn lever. When a key or thumb turn lever locks or unlocks the lock assembly, various internal components are moved and or actuated within the lock assembly. The internal components are not shown in the drawings, but are operably connected to the drive bar receptacle that is rotated in either in a clockwise or counter-clockwise direction depending on the design of the particular lock assembly. The drive bar is connected with and extends between the drive bar receptacle and the cam so that when the lock is moved from a locked or unlocked position, the cam will rotate in a predetermined direction. The rotation of the cam in turn causes the indicator plate to move between first and second positions and in the exemplary embodiment between the upper and lower abutments of the base plate. In this manner the status indicators will move relative to the windows such that the correct status indicator is positioned to be displayed through the front and side windows of the escutcheon plate. The escutcheon assembly is configured such that the status indicator is visible through the front face window and from each of the opposing side windows formed in the escutcheon plate. In this manner a person that is approaching the escutcheon assembly from any angle can visually see whether or not the lock is in a locked orientation or an unlocked orientation. The status indicator is visible through a 180° angle so that one can quickly determine whether the door is locked or not without having to move to a front facing angle or actually trying to physically open the door.

It should be understood that the escutcheon assembly illustrated in the drawings is exemplary in nature and not limiting, as such many different shapes, sizes or orientations of the escutcheon assembly are contemplated for purposes of this patent application. For example, the escutcheon assembly, can be positioned to operate vertically, horizontally or in any desired position therebetween.

It should be further noted that the escutcheon assembly and lock assembly can be designed for many different purposes such as doors on buildings, bathroom stalls, lockers, freezers, refrigerators, safes, utility vehicle bays, tool boxes or other movable structures that can be advantageously locked with the apparatus defined by the present disclosure. As such, different materials can be used as desired for different applications. For example, metals, plastics, composites, as well as surface coatings and lubrication can be used in various forms.

Also, the status indicators can include any visible descriptor desired to enhance visibility. For example, different color schemes can be utilized with or without additional words, phrases and/or symbols. Additionally material that "glows in the dark" may also be used in some applications. In this exemplary disclosure, a closed padlock symbol and an open padlock symbol is depicted, but other symbols can be used as desired.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. An apparatus comprising:

a lock assembly operable to mechanically lock a moveable structure to a fixed structure;

an indicator plate coupled with the lock assembly and movable between a first position and a second position to indicate one of a locked and unlocked configuration of the lock assembly;

a status indicator including a plurality of indicator portions located proximate a front face and a pair of opposing side faces on the indicator plate to display a locked or unlocked status across a 180 degree viewing angle.

2. The apparatus of claim 1, wherein the indicator portions of the status indicator includes a color scheme to indicate a locked and an unlocked configuration.

3. The apparatus of claim 1, wherein the indicator portions of the status indicator includes drawings, symbols or illustrations to indicate a locked and an unlocked configuration.

4. The apparatus of claim 1, wherein the indicator portions of the status indicator includes letters forming words or phrases to indicate a locked and an unlocked configuration.

5. The apparatus of claim 1 further comprising:

a rotatable cam actuated by locking and unlocking the lock assembly.

6. The apparatus of claim 5 further comprising:

a cam follower profile operably connected with the indicator plate and engageable with the cam, whereby rotational movement of the cam causes translational movement of the indicator plate.

7. The apparatus of claim 5, wherein the cam includes a pivot shaft rotatably supported through a reinforcement plate.

8. The apparatus of claim 5 further comprising:

a drive bar coupled between the lock assembly and the cam for transmitting rotational torque to the cam when the lock assembly is locked or unlocked.

9. The apparatus of claim 1 further comprising:

a reinforcement plate positioned between the indicator plate and the lock assembly.

10. The apparatus of claim 7, wherein the reinforcement plate includes a guide portion for the indicator plate to slidingly engage therewith.

11. A status indicator for a lock comprising:

a base plate operably coupled to a lock assembly;

an indicator plate having a front face with side walls extending therefrom being slidingly engageable with the base plate;

a status indicator including a plurality of indicator portions located on the front face and on each of the side walls of the indicator plate to indicate one of a locked and an unlocked status of the lock assembly; and a cam follower profile connected to the indicator plate.

12. An apparatus comprising:

a lock assembly operable to mechanically lock a moveable structure to a fixed structure;

an indicator plate coupled with the lock assembly and movable between a first position and a second position to indicate one of a locked and unlocked configuration of the lock assembly;

a status indicator located proximate a front face and a pair of opposing side faces on the indicator plate to display a locked or unlocked status across a 180 degree viewing angle; and an escutcheon plate positioned over the indicator plate, the escutcheon plate having a front window and a pair of side windows positioned to show the indicator portions of the status indicator on the indicator plate.

13. The status indicator of claim 12 further comprising:

a cam rotatably coupled to the lock assembly having a working portion engaged with the cam follower profile of the indicator plate.

14. The status indicator of claim 13, wherein the working portion includes a pin protruding substantially transverse to a cam lobe.

15. The status indicator of claim 13, wherein the indicator plate translates in a first direction when the cam is rotated clockwise and translates in a second direction when the cam is rotated counter-clockwise.

16. The status indicator of claim 12 further comprising:

an escutcheon plate connected to the base plate and enclosing the indicator plate therebetween, the escutcheon plate having openings in a front face and sidewalls to permit visibility of the indicator portions of the status indicator.

17. A method comprising:

placing a status indicator including a plurality of indicator portions on two or more walls of an indicator plate, the indicator portions of the status indicator including a locked and an unlocked indicator;

rotating a cam in a first direction when a lock assembly is moved to a locked configuration;

rotating the cam in an opposing direction when the lock assembly is moved to an unlocked configuration;

sliding the indicator plate between first and second positions in response to rotation of the cam; and displaying at least one of the indicator portions on each of the two or more walls of the status indicator through a 180 degree viewing angle.

18. The method of claim 17, wherein the status indicator display includes color variation between the locked and the unlocked status.

19. The method of claim 17, wherein the status indicator display includes alphanumeric characters and/or symbols.

20. The method of claim 17, wherein the rotating of the cam is caused by rotation of a key or a pivotable lock lever.

21. A lock apparatus comprising:

a slidable indicator plate having a three lobed deadlocking cam follower profile connected thereto, the slidable indicator plate including a plurality of indicator portions located on the front face and on an opposing pair of side faces of the slidable indicator plate to indicate one of a locked and an unlocked status of the lock apparatus;

a rotatable cam having a pin engageable with the deadlocking cam follower profile;

wherein rotation of the cam causes the pin to move along a perimeter of the cam follower profile across an intermediate lobe positioned between a first lobe and a third lobe; and wherein the first lobe and the third lobe of the cam flower profile corresponds to a locked and unlocked orientation of the lock apparatus, respectively.

22. The lock apparatus of claim 21, wherein the indicator plate is slidable between first and second positions when the pin is moved between the first and third lobes of the cam follower profile.

23. The lock apparatus of claim 21, wherein the cam is rotated between the first and third lobes when a key, thumb turn lever or electric actuator locks and unlocks the lock apparatus.

24. The lock apparatus of claim 21, wherein the three lobed deadlocking cam follower prevents the indicator plate from moving when an external force is applied to the indicator plate without rotation of the cam.

25. The lock apparatus of claim 21, wherein the deadlocking cam follower profile cannot slidingly translate until the pin of the cam is rotated into engagement with the intermediate lobe.

26. The lock apparatus of claim 21, wherein the indicator plate is unmovable when the pin of the cam is engaged with either the first or the third lobe of the deadlocking cam follower profile.

* * * * *